US008590196B2

(12) United States Patent
Elliott et al.

(10) Patent No.: US 8,590,196 B2
(45) Date of Patent: Nov. 26, 2013

(54) DISPLAY APPARATUS

(71) Applicants: Mark Elliott, Caledon (CA); Robert Murray, Oakville (CA); Ryszard Kisiel, Mississauga (CA)

(72) Inventors: Mark Elliott, Caledon (CA); Robert Murray, Oakville (CA); Ryszard Kisiel, Mississauga (CA)

(73) Assignee: Mark Elliott, Caledon, Ontario (CA)

( * ) Notice: Subject to any disclaimer, the term of this patent is extended or adjusted under 35 U.S.C. 154(b) by 0 days.

(21) Appl. No.: 13/659,854

(22) Filed: Oct. 24, 2012

(65) Prior Publication Data

US 2013/0145661 A1 Jun. 13, 2013

Related U.S. Application Data

(60) Provisional application No. 61/550,862, filed on Oct. 24, 2011.

(51) Int. Cl.
*A47G 1/06* (2006.01)

(52) U.S. Cl.
USPC ..... 40/716; 40/549; 40/564

(58) Field of Classification Search
USPC ..... 40/549, 575, 564, 700, 716, 798
See application file for complete search history.

(56) References Cited

U.S. PATENT DOCUMENTS

| | | | | | |
|---|---|---|---|---|---|
| 1,348,957 | A | * | 8/1920 | Pope | 40/444 |
| 1,448,625 | A | | 3/1923 | Hammack et al. | |
| 1,523,737 | A | * | 1/1925 | Willard | 40/575 |
| 1,717,738 | A | * | 6/1929 | Schwarz | 427/197 |
| 1,843,841 | A | | 2/1932 | Ryerson, Jr. | |
| 3,696,885 | A | * | 10/1972 | Grieg et al. | 181/141 |
| 5,457,615 | A | * | 10/1995 | Nezer | 362/223 |
| 7,369,310 | B1 | * | 5/2008 | Risher | 359/443 |
| 2008/0029336 | A1 | * | 2/2008 | Sigler et al. | 181/293 |
| 2010/0085774 | A1 | | 4/2010 | Park | |

FOREIGN PATENT DOCUMENTS

| | | | |
|---|---|---|---|
| WO | WO2006/129246 | A2 | 12/2006 |
| WO | WO2010/005810 | A2 | 1/2010 |

OTHER PUBLICATIONS

International Search Report for International Application No. PCT/CA2012/000982, published Jan. 30, 2013.

* cited by examiner

*Primary Examiner* — Gary Hoge
(74) *Attorney, Agent, or Firm* — Matthew A. Pequignot; Pequignot + Myers LLC

(57) ABSTRACT

Apparatus which can be operated to selectively hide or reveal visual or graphical displays or material. In some embodiments, an apparatus useful for presenting advertising material which can be operated to reveal or display graphical advertising in a display-mode and, conversely, to hide or conceal such graphical advertising when in a conceal-mode.

17 Claims, 13 Drawing Sheets

A- FABRIC WITH KEDDER
B- LIGHT SOURCE
C- LEAD CLOTH
D- EXTRUSION
E- ACOUSTIC CORE

DISPLAY APPARATUS

RELATED APPLICATION DATA

This application claims priority to U.S. Provisional Patent Application No. 61/550,862, filed Oct. 24, 2011, the entirety of which is hereby incorporated by reference.

FIELD OF INVENTION

Apparatus which can be operated to selectively hide or reveal visual or graphical displays or material. In some embodiments, an apparatus useful for presenting advertising material which can be operated to reveal or display graphical advertising in a display-mode and, conversely, to hide or conceal such graphical advertising when in a conceal-mode.

BACKGROUND OF THE INVENTION

Although advertising in conjunction with movie presentations is well-known in the art, the use of advertising in movie theatres has previously been limited to pre-feature projections on movie theatre screens or printed material contained or displayed on concession purchases, for example.

Although a conventional movie theatre typically contains ample wall space for presenting additional, revenue-generating advertisements, large-format graphic displays for advertising, promotion or design purposes have heretofore not been possible within the theatre environment due to the combination of one or more limitations.

For example, it is undesirable for an advertising display to remain visible to the audience during the presentation of the movie feature. Moreover, traditional signage materials have undesirable acoustic qualities and thus would negatively impact the acoustical component of a movie presentation in a conventional theatre space. As a result of the potential for visual distraction and/or acoustic interference with the use of conventional advertising signage, even though advertising is an attractive revenue stream, movie theatres have heretofore avoided the use of such advertising both to avoid objection by movie studios and distributors and to avoid the potential loss of customers which might result from such usage.

In addition to the above-enumerated problems or drawbacks in the prior art, even if conventional signage displays were acceptable during certain movie presentations, such signage might not be acceptable when viewable during other presentations because of possible specific content conflict or specific studio objection, for example. Furthermore, utilizing conventional signage does not permit cost and/or labor efficient or environmentally friendly mechanisms or methods for changing, modifying, or removing advertising content.

In sum, it would be desirable in the art to have an apparatus or method which can be utilized to provide or display advertising on the otherwise unused wall space within a movie theatre (or other theatre type) which can be concealed or hidden or removed from view during the actual feature presentation. In addition—although not required—it would be desirable to have such a device which is more environmentally friendly, more cost and/or labor efficient to change advertising content (including, in certain non-limiting examples, with which advertising content can be modified or changed with no manual intervention) and/or which will not interfere with the acoustical elements or components of a feature presentation. Similarly, it would be desirable to be able to advertise to theatre patrons on heretofore unused wall space after the completion of the feature movie (or other type) presentation.

In view of these and other desires for improvements in the art, it is a purpose of the herein described invention to address one or more of such desires as well as, or in the alternative, other needs which will become more apparent to the skilled artisan once given the present disclosure.

SUMMARY OF CERTAIN EXAMPLES OF THE INVENTION

Generally speaking, this invention relates to apparatus or devices (or methods for using such devices or apparatus) which are structurally designed and configured so as to be capable of selectively displaying visual or graphical material to a viewer or viewers (e.g., advertising content or material). In some embodiments, apparatus or devices are provided which are capable of being selectively switched between at least two modes. More particularly, in such embodiments, such apparatus or devices can be switched between at least a "display-mode" in which visual or graphical material (e.g., advertising material) is visible or displayed and a "conceal-mode" in which such visual or graphical material is concealed from view or display. In certain embodiments, such devices and/or apparatus and/or methods are provided for exploiting the heretofore unused wall surfaces in theatre environments and/or similar space within other low ambient light presentation or entertainment areas.

In some embodiments, the apparatus and/or methods provided are structurally designed and/or configured so that they will not negatively interfere with the acoustical environment of the theatre or auditorium in which they are installed and/or will not interfere with or otherwise negatively impact the acoustical components or elements of a feature movie presentation, for example.

In other embodiments, alone or in combination with the other features described above, the apparatus or methods provided allow advertisements to be displayed, through use of internal illumination (e.g., back or side lighting), on wall surfaces of movie theatres prior to the display of the feature movie presentation, and such advertisements can thereafter be hidden or otherwise concealed from the view of movie theatre attendees by dimming or turning off the internal illumination. In certain preferred embodiments, the apparatus is provided with an acoustic sheer layer which is substantially or completely visually transparent when illuminated by the apparatus lighting but which is effectively opaque or "non-see-through" when not so illuminated (in preferred, but not necessarily all, embodiments, such acoustic sheer layer is visually non-reflective). In still additional embodiments, the acoustic sheer layer is acoustically neutral or transparent or otherwise acoustically tailored so as not to interfere with the acoustical performance of a movie presentation. In still additional embodiments, the graphical/visual advertising content is printed or otherwise contained on a separate layer (e.g., a fabric layer) which is also acoustically neutral or transparent or otherwise desirably acoustically tailored. In certain preferred embodiments, a frame or similar mounting mechanism is provided for mounting or carrying the acoustic sheer layer, the visual graphical layer, and the device illumination system (e.g., a configuration of LED or other suitable lights). In some (but not all) preferred embodiments, the apparatus also includes an acoustic core. The acoustic core, when utilized, can be tailored and/or selected to provide desirable acoustic qualities to the apparatus. For example, the acoustic core can be tailored and/or selected so that it matches the acoustic qualities or characteristics of the respective movie theatre or auditorium in which it is installed.

In certain particularly preferred (but optional) embodiments, the visual or graphical layer (e.g., fabric or other type layer containing advertising content) is mounted or carried on a roller system such as depicted in the example drawings submitted with this provisional patent application. Using such a roller system combined with fabric-printed graphics, content displayed by the apparatus can be changed both inexpensively and with minimal labor by simply removing and replacing "rollers" (e.g., different rollers can be "loaded" with different advertising content) or by using, for example, a roller system in which differing or multiple types of advertising material (or other graphical content) are loaded onto a single roller. Using such an (optional) system in combination with a motor-powered roller (as one non-limiting example), displayed content can be changed remotely or automatically (such as by use of pre-programming and/or pre-timing) by motor operation of the roller to unveil or unroll alternative or different graphical/visual content (e.g., onto a corresponding "take-up" roller) at different times. For example, different advertising content could be displayed before the start of and after the conclusion of a feature movie presentation.

In certain optional embodiments, a display apparatus includes a unique composition of dye-sublimation printed graphics on an acoustically transparent fabric which is contained within or on a frame behind an acoustic sheer. Also contained within the frame in this embodiment, behind the printed graphics, are optional LED lights to illuminate the dye sublimation printed image and a 1" thick acoustic core backing which maintains the acoustic balance of the room. Other thicknesses of acoustic core backing may of course be used (e.g., between, but not limited to between, $1/8^{th}$ and 6" thick backing).

In certain other embodiments (alone or in combination with one or more features of other embodiments described herein), prior to a feature movie presentation (e.g., during a pre-show), LED lights can be employed to illuminate the printed image or graphics, making the content visible to the audience. Once the feature presentation begins, LED lights may be dimmed or turned off completely so that the printed image/graphics disappear(s) from view behind the (preferably) non-reflective acoustic sheer. The unit, in some embodiments, is designed so that it blends into the existing acoustic wall treatment, retreating from the audience's line of sight. In certain preferred embodiments, although not required, the printed graphics are loaded into a demountable roller cartridge which allows for quick and easy replacement of graphics/printed content (e.g., using pre-loaded cartridges). Roller cartridges may be, but are not required to be, reusable or recyclable.

In at least one particularly preferred embodiment, there is provided apparatus comprising: a frame having opposing rail portions; a first fabric layer, carried by the frame, which is substantially acoustically transparent and which is at least partially visually transparent when backlit with light and which is substantially opaque when not backlit with light; a second fabric layer, located behind and physically concealed by the first fabric layer and carried by the frame, the second fabric layer being at least partially light transmissive and including graphical images on at least a portion of a surface area thereof; a third layer, spaced from and located behind the second fabric layer, comprised of a reflective surface facing the second fabric layer; a plurality of light sources so physically located and oriented so as to, when turned on, provide a light field between the second fabric layer and the third layer, the reflective surface of the third layer interacting with the light field, when the plurality of light sources are turned on, to assist in homogenization of a brightness of the light field so as to result in a backlighting source comprised of a substantially continuous light field of substantially uniform brightness which, at least partially, transmits through the second fabric layer and the first fabric layer in a substantially uniform visually perceptible brightness; and wherein, when the plurality of light sources are turned on, the graphical images located on the second fabric layer are visually viewable when viewing an outward facing surface of the first fabric layer; and wherein when the plurality of light sources are turned off, the first fabric layer is substantially opaque and thereby conceals the graphical images from visual perception.

In certain non-limiting alternative examples of the above embodiment, or in combination with any of the other embodiments described herein, the frame of the apparatus comprises a first set of two opposing rail members with a plurality of light sources mounted thereon, each of the two opposing rail members of the first set including light sources oriented generally facing each other, and a second set of two opposing rail members connected to the first set of two opposing rail members, the second set of two opposing rail members including reflective surfaces oriented generally facing each other.

In certain non-limiting alternative examples of the above embodiment, or in combination with any of the other embodiments described herein, the first and second sets of opposing rail members are connected to form a frame having a generally rectangular configuration ("rectangle" being defined herein to include any geometric shape having four sides connected at four corners of approximately 90 degrees each, regardless of whether the sides are the same or different lengths).

In certain non-limiting alternative examples of the above embodiment, or in combination with any of the other embodiments described herein, the first set of two opposing rail members, with the plurality of light sources mounted thereon, are shorter in length than the second set of two opposing rail members.

In certain non-limiting alternative examples of the above embodiment, or in combination with any of the other embodiments described herein, the first fabric layer is mounted in a first plane spaced a distance x from the second fabric layer mounted in a second plane and wherein the third layer is mounted in a third plane spaced a distance y from the second layer on a side of the second layer opposite the location of the first layer.

In certain non-limiting alternative examples of the above embodiment, or in combination with any of the other embodiments described herein, the first fabric layer is a sheer layer comprising warp knitted polyester mesh, having a weight selected from between approximately 2.8 and 4.8 oz per square yard, penetrated on both sides with printing ink.

In certain non-limiting alternative examples of the above embodiment, or in combination with any of the other embodiments described herein, the second fabric layer comprises warp knitted polyester mesh, having a weight selected from between approximately 6 and 10 oz per square yard, with graphical images printed thereon.

In certain non-limiting alternative examples of the above embodiment, or in combination with any of the other embodiments described herein, the third layer is a fabric layer comprising warp knitted polyester mesh, having a weight selected from between approximately 6 and 10 oz per square yard, which is optically white on at least one side.

In certain non-limiting alternative examples of the above embodiment, or in combination with any of the other embodiments described herein, the plurality of light sources are LED lights.

In certain non-limiting alternative examples of the above embodiment, or in combination with any of the other embodiments described herein, the plurality of light sources are LED lights mounted spaced between 1.5 to 4.0 inches apart projecting a combination of broad and narrow light beams at one or more angles such that, the combination of broad and narrow light beams, in aggregate, form the backlighting source comprised of a substantially continuous light field of substantially uniform brightness.

In certain non-limiting alternative examples of the above embodiment, or in combination with any of the other embodiments described herein, the plurality of light sources are LED lights mounted spaced between 1.5 to 4.0 inches apart projecting a combination of broad and narrow light beams at one or more angles such that, the combination of broad and narrow light beams, in aggregate, form the backlighting source comprised of a substantially continuous light field of substantially uniform brightness, and wherein the narrow beams are projected at angles selected from between approximately 5 and 15 degrees and the broad beams are projected at angles selected from between approximately 40 and 50 degrees.

In certain non-limiting alternative examples of the above embodiment, or in combination with any of the other embodiments described herein, the plurality of light sources are LED lights mounted spaced between 1.5 to 4.0 inches apart, the LED lights projecting a combination of broad and narrow light beams at one or more angles such that, the combination of broad and narrow light beams, in aggregate, form the backlighting source comprised of a substantially continuous light field of substantially uniform brightness, and wherein the narrow beams are projected in a selected manner to reflect off of the third layer and the reflective surfaces of the opposing rail members, in combination, and the broad beams are projected in a selected manner to diffuse light across broad portions of the second fabric layer.

In certain non-limiting alternative examples of the above embodiment, or in combination with any of the other embodiments described herein, the plurality of light sources are LED lights which are dimmable.

In certain non-limiting alternative examples of the above embodiment, or in combination with any of the other embodiments described herein, the second fabric layer contains graphical images printed with dye sublimation techniques.

In certain non-limiting alternative examples of the above embodiment, or in combination with any of the other embodiments described herein, the plurality of light sources are LED lights equipped with substantially oval lenses.

In certain non-limiting alternative examples of the above embodiment, or in combination with any of the other embodiments described herein, the distance x is selected from between approximately ¼ and ¾ of one inch.

In certain non-limiting alternative examples of the above embodiment, or in combination with any of the other embodiments described herein, the distance y is selected from between approximately 2 and 12 inches.

Certain examples of the invention are now described below with respect to certain non-limiting embodiments thereof as illustrated in the following drawings wherein:

BRIEF DESCRIPTION OF CERTAIN EXAMPLE DRAWINGS

The drawings submitted with and which form a part of this patent application each illustrate an embodiment, or one or more components of an embodiment, of a non-limiting example of Applicants' invention. While these drawings depict certain preferred embodiments of Applicants' invention, as well as certain particularly desirable features thereof, they are intended to be examples only and should not be construed to limit the scope of Applicants' invention.

DESCRIPTION OF CERTAIN NON-LIMITING EXAMPLE EMBODIMENTS

For a more complete understanding of the present invention, reference is now made to the following description of various illustrative and non-limiting embodiments thereof, taken in conjunction with the accompanying drawings in which like reference numbers indicate like features.

Figure 1:
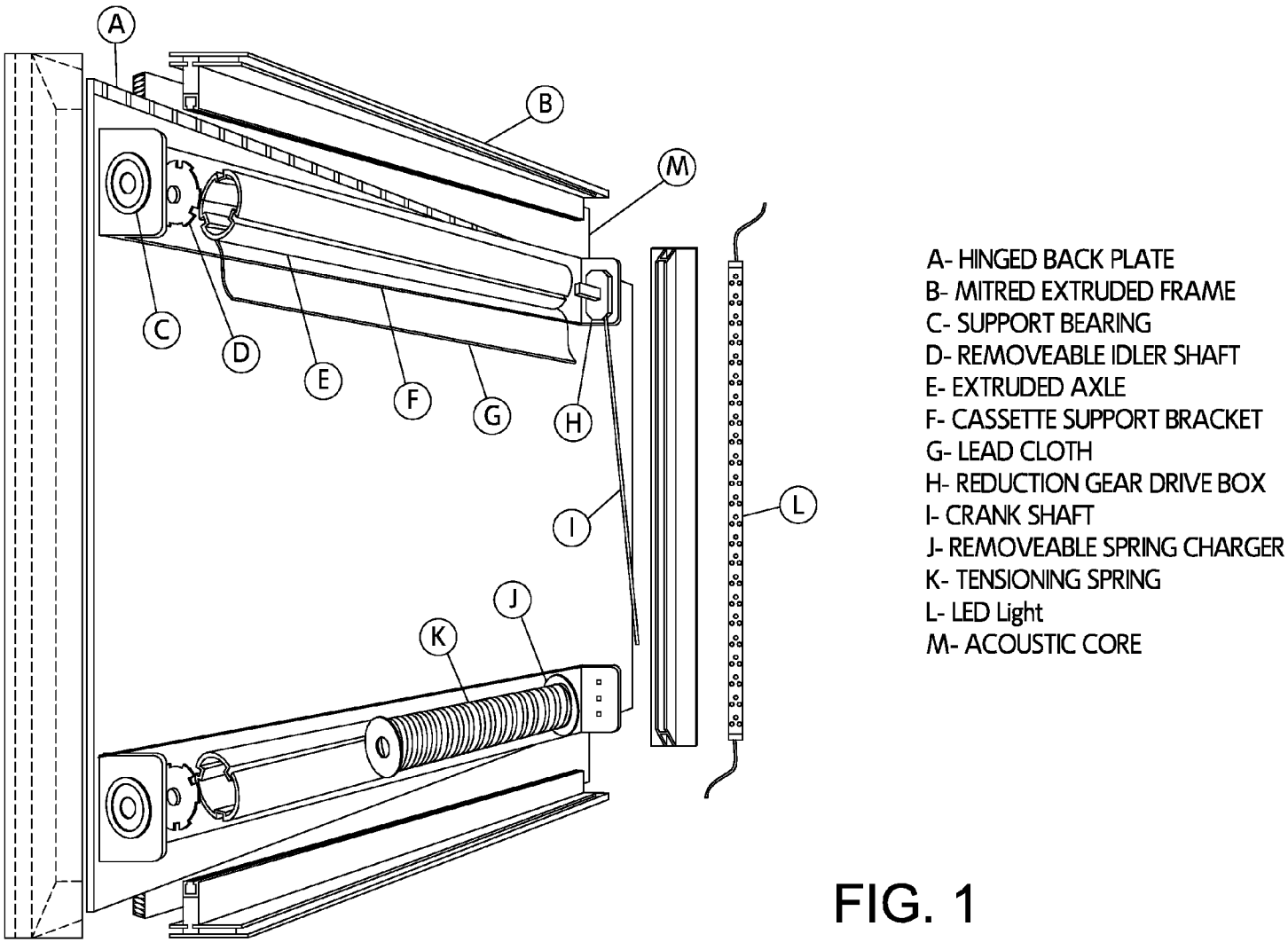
FIG. 1 illustrates one embodiment of a display apparatus according to the subject invention.
Figure 2:
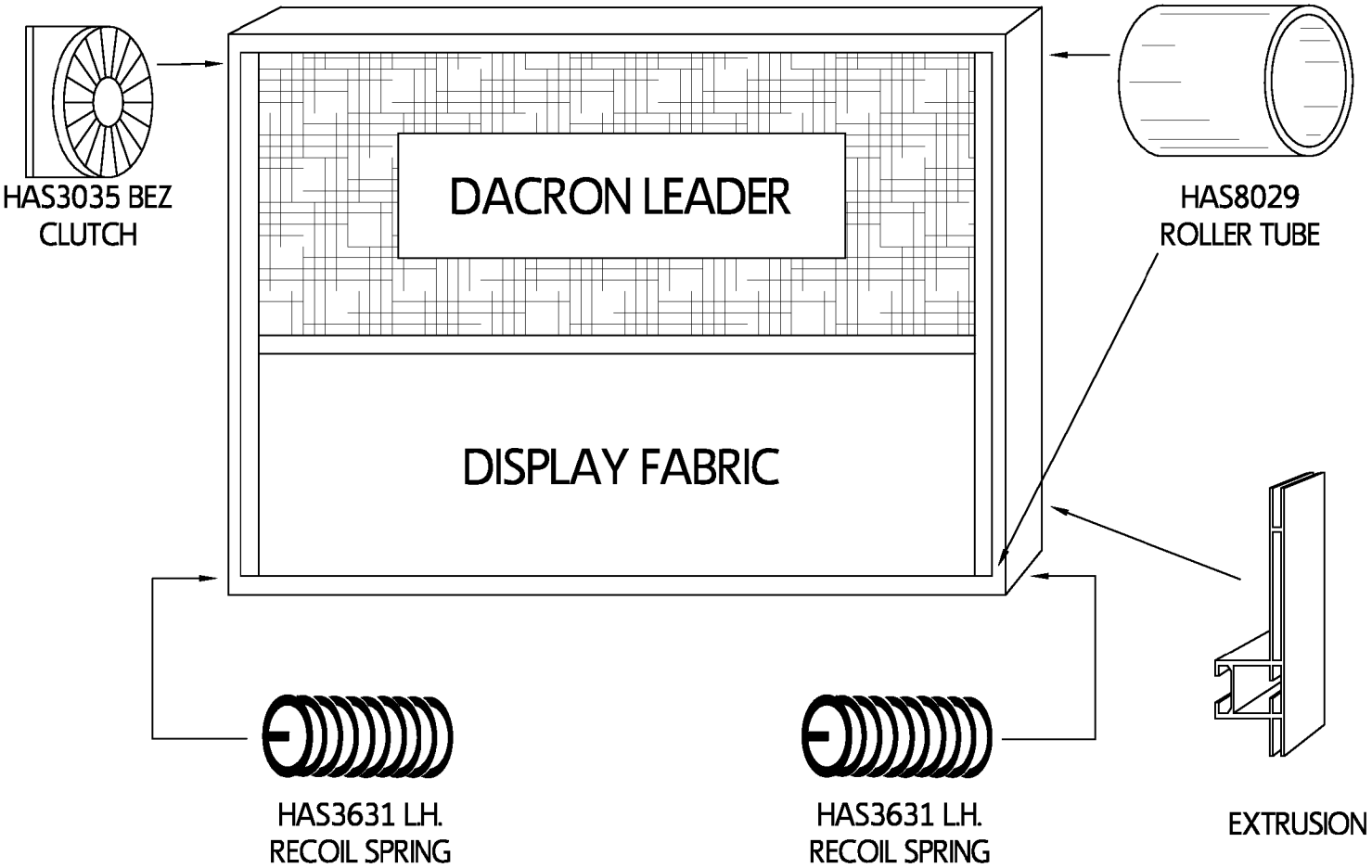
FIG. 2 illustrates certain example components of the example display apparatus illustrated in FIG. 1.
Figure 3:
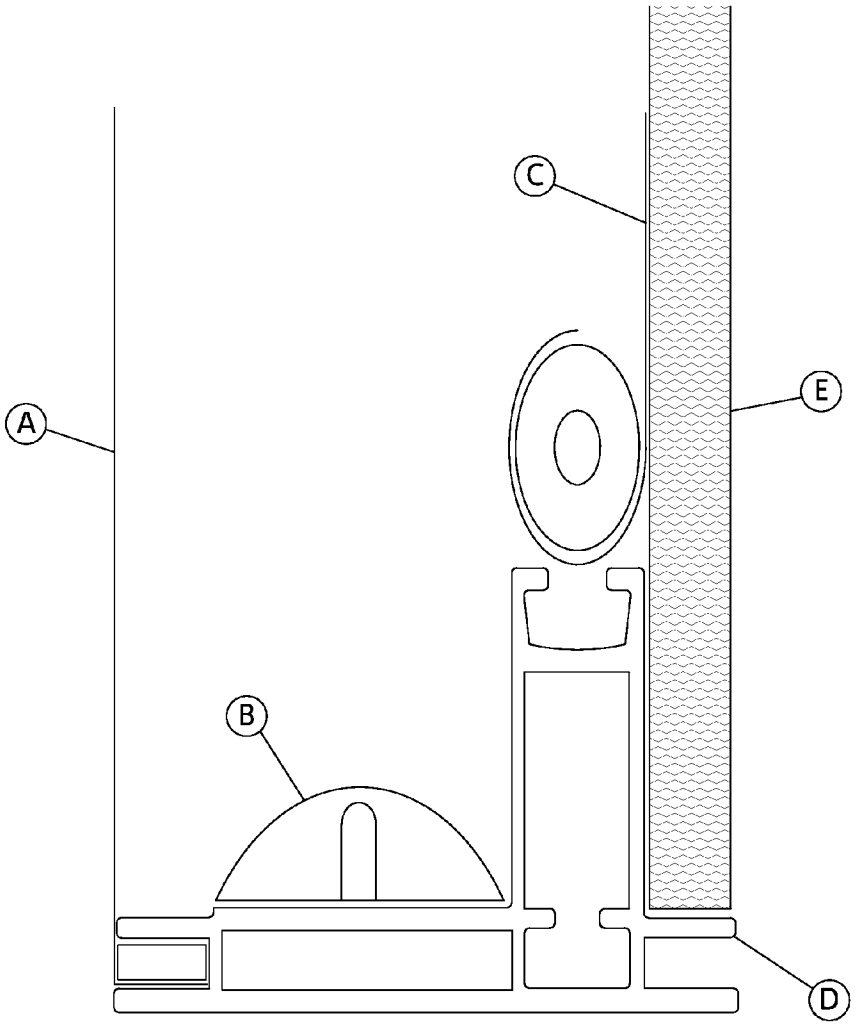
FIG. 3 illustrates certain different example components of the example display apparatus illustrated in FIG. 1.

Referring initially to FIGS. 1-3, a non-limiting example of the inventive apparatus is depicted therein. Generally speaking, the apparatus illustrated in these figures includes a frame carrying a first layer (e.g., a fabric layer) displaying a printed image (e.g., advertising content) and a second layer (e.g., a second fabric layer such as an acoustic sheer layer) disposed over and preferably spaced from said first layer. In particular, the second layer is selectively, visually (substantially or completely) transparent. In addition, the frame carries or includes, mounted thereto, one or more illuminating members located and designed so that when they are illuminated (such as in a display-mode), the second layer is substantially or completely visually transparent to reveal the printed image/content on the first layer, and when not illuminated (such as in a conceal-mode), the second layer conceals the printed image/content.

The following is a more detailed list and description of certain example components particularly useful with the apparatus depicted in FIGS. 1-3:

1. Acoustic Sheer: The outer sheer layer is transparent (substantially or completely) when the unit is back lit thus allowing full or at least adequate visibility of the printed image (e.g., when illuminated from behind). Once the light source is turned off and the house lights go down, the image is concealed (preferably completely) behind the sheer (e.g., in certain embodiments, it is effectively opaque when not back lit). The outer surface of the sheer is preferably designed to match the surrounding wall treatments so that the entire unit blends into the surrounding wall treatments. It is desirable in a theatre environment that no content remain visible in the peripheral vision of the audience as this will detract from the feature presentation. The acoustic sheer also allows sound energy to pass directly through so it can be absorbed by the acoustic backer behind the graphics.

2. Digitally Printed Acoustic Fabric: The content of the display is printed onto acoustically transparent fabric to create a high definition non-glare finish. The fabric finish has numerous benefits within a theatre environment over traditional print materials like vinyl or wall paper. The printed fabric image is then loaded a roller cartridge that allows for easy replacement of the content.
3. Pre-Loaded Graphics Cartridge: Printed graphics are pre-loaded on demountable roller cartridges. Roller cartridges may be spring-loaded to allow for the quick and easy replacement of display content. Cartridges may be 100% re-usable and recyclable. In certain embodiments, multiple graphics sets can be loaded onto a single roller. In other embodiments, the rollers can be mechanized or motor operable (directly or remotely).
4. Acoustic Core: Differentiating from traditional light box or billboards, the apparatus described herein preferably include or contain an acoustic core backing that matches the acoustic absorption of the surrounding acoustic wall treatment. When using this acoustic construction, displays can be inserted into either new or existing theatre environments without negatively or substantially compromising acoustics.
5. LED Lights: LED lighting strips may be mounted behind the printed graphics so that when they are illuminated, they create a uniform glowing effect in conjunction with the display of the image. Lights are preferably completely concealed within the frame. Lighting may be tied directly into the theatre automation system for ease of use. LED lights used in the system, when employed, are energy efficient. Other lighting types may, of course, be utilized or employed.
6. Frame: A continuous extruded frame supports and houses all the components listed above. The durable frame is designed for easy installation and integration into all types of wall construction. Other frame types may, of course, be employed.

While each of the above-described components are excellent for their intended purposes, they are not each required to be utilized or employed as exactly described or otherwise depicted and certain/each component(s) may be reconfigured or replaced or repositioned without departing from the scope of the invention.

In certain example embodiments, the apparatus will employ high definition dye-sublimated printed graphics and/or an acoustically absorptive construction. Embodiments may also have (but are not required to have) a multi-layer construction allowing images to completely disappear when the feature presentation begins. While LED lighting is useful for illuminating the display for vivid and colourful presentation, other lighting types, alone or in combination with LED lighting, may be used.

The following is a list of example features and benefits that the herein-described invention provides. While certain embodiments of the invention provide all of these features, other embodiments may only provide one of these features or benefits or some smaller combination of such features and benefits:

Non-Limiting Example Summary of Certain Features and Benefits

- No visual distraction during feature presentation, including no distraction from peripheral view
- No or little compromise to theatre acoustics
- Large eye catching visual display—an example size is 10'×6' with any number of infinite custom sizes available
- Easy integration into new or existing wall construction
- Integrates easily into existing automation systems i.e., it can be operated in tandem with existing theatre lighting systems
- Easy to change pre-loaded graphics cartridges allow for full control over display content and easy replacement of graphics
- Graphics cartridges can be motor operated and/or loaded with multiple graphic(s) sets
- Preferred use of non-glare fabrics or layers gives non-glare performance in both the on (display-mode) and off (conceal-mode) positions to ensure no unwanted visual distraction
- Option for 3D printing and glow printing through use of special ink formulations
- New revenue streams are possible using the invention
- Creation of a new medium for advertising, promotion, branding or design enhancement
- Certain embodiments provide a new rentable space within theatres
- Creates a defined and determined target market for advertisers
- Provides a new media platform in cinemas
- In addition to pre-show advertising in conjunction with on-screen advertising, now in-theatre, post-show advertising is possible
- Printed graphics may be tailored or selected to be 100% recyclable or reusable
- Optional use of water based ink and printing processes which are eco friendly
- Optional energy efficient LED lighting Referring now to FIGS. 4-7C, a particularly preferred example of a display apparatus 101 according to the subject invention is depicted therein. Display 101, in this regard, generally comprises a frame 103 (e.g., aluminium) carrying preferably three fabric layers. The outermost or first layer 115 is an acoustic sheer layer which is designed to be substantially visually opaque when not backlit with a lighting source. Conversely, however, when layer 115 is backlit, it becomes at least partially visually transparent, and is substantially visually transparent (when backlit) in preferred embodiments. Located physically concealed behind layer 115 is a second fabric layer 117 upon which graphical images are printed. Mounted or installed spaced behind layer 117 is a third layer 119 which is preferably a light diffuser or reflector layer. Each layer 115 and 117 is preferably installed on frame 103, as best seen in FIG. 5A, with the use of kedders 116 and 118 (e.g., plastic) which are manually insertable into corresponding slots or grooves 105 and 107, respectively. Third layer 109, however, is connected to frame 103 using a hook and loop, or Velcro, type connection (an acoustic core or layer 125 may also be installed, as shown, if desired). Of course, other mechanisms or methods may be used to attach or install the respective layers to the frame system.

Figure 7A:
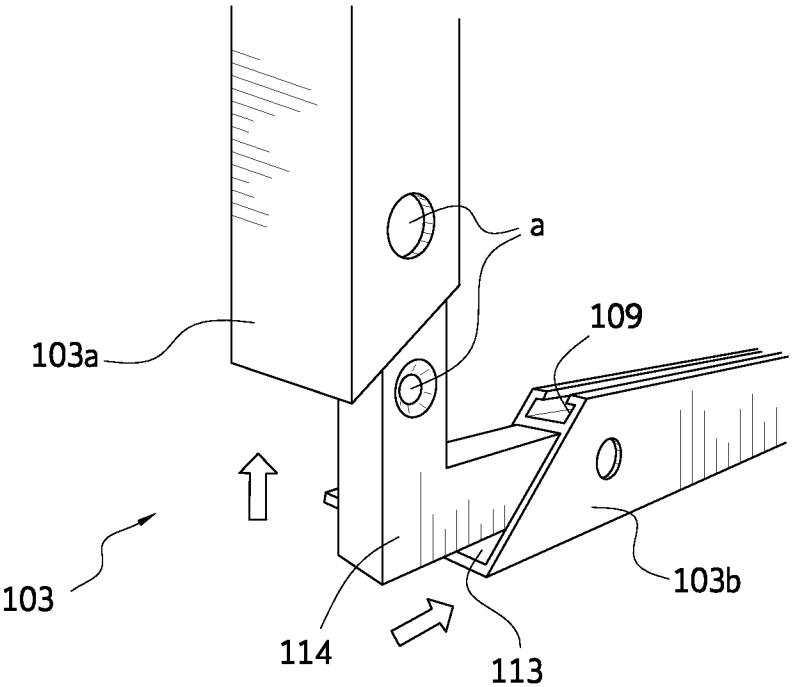
FIG. 7A illustrates an example of a connector mechanism for assembling one embodiment of a frame according to one example of the invention.
Figure 7B:
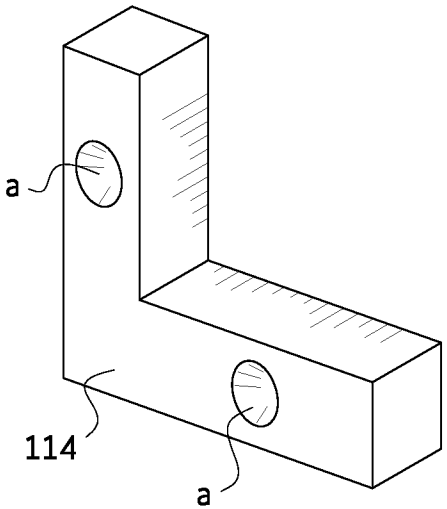
FIG. 7B illustrates a portion of a frame according to one embodiment of the subject invention.
Figure 7C:
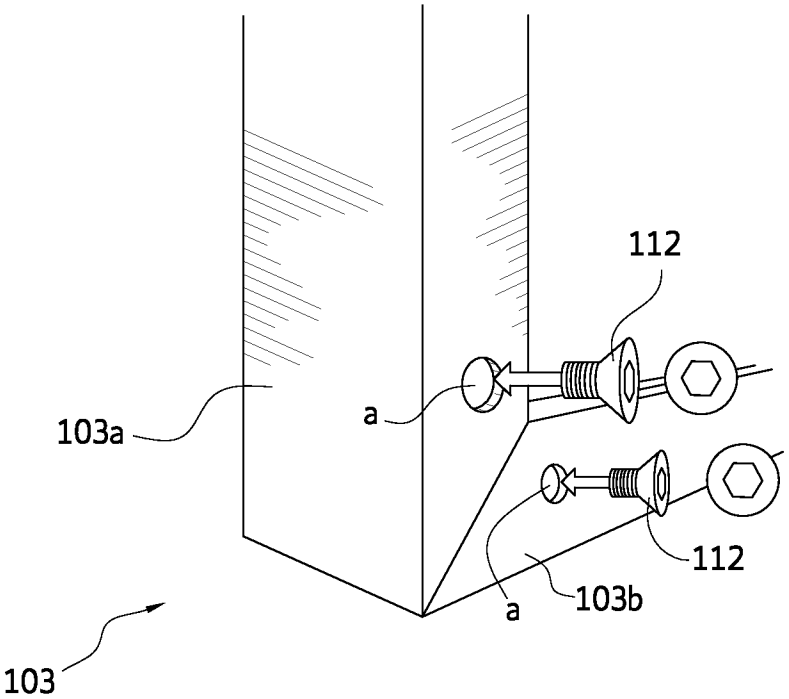
FIG. 7C illustrates the same frame embodiment depicted in FIG. 7A in a more fully assembled state.

Frame 103, in turn, is comprised (in this example embodiment) of four frame rail members connected to one another using a male/female connector type mechanism. As seen in FIGS. 7A-7C, for example, frame rails 103*a* and 103*b* each include a receiving channel 113 for receiving a correspondingly sized male connector member 114. By installing member 114 into the respective channels 113, the frame rails of frame 103 can be securely held together with the use of conventional screw fasteners threaded into apertures "a".

Figure 4:
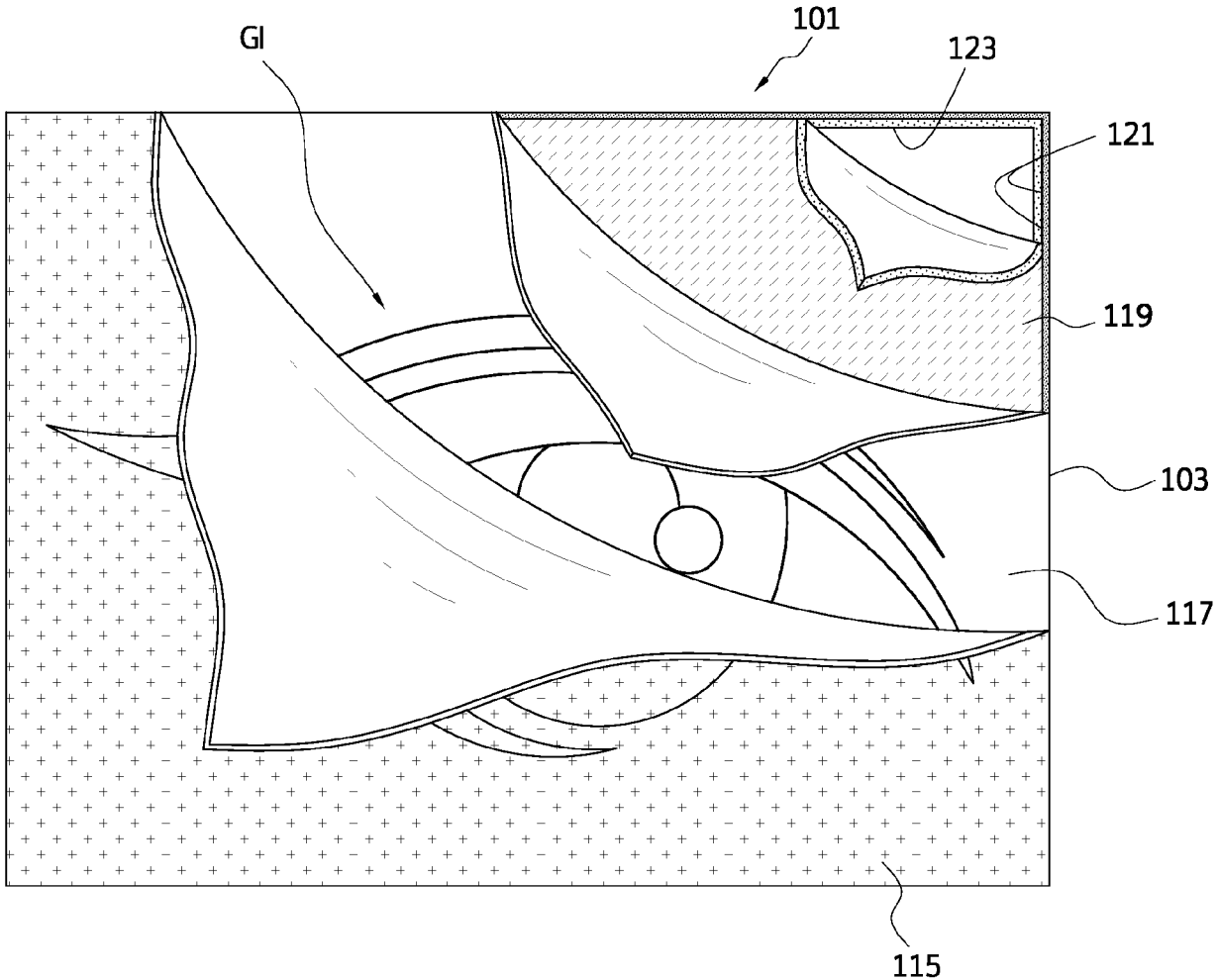
FIG. 4 illustrates an alternative embodiment of a display apparatus according to the subject invention.
Figure 5A:
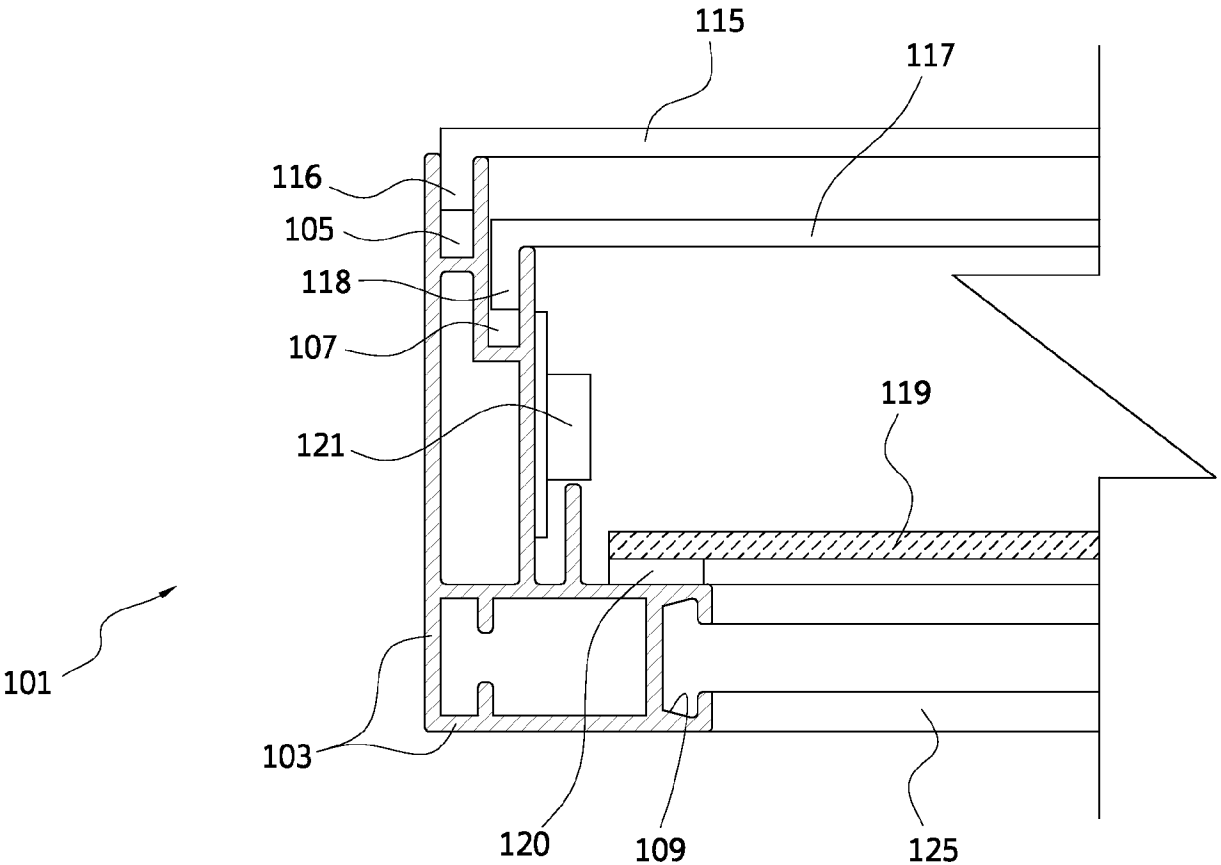
FIG. 5A illustrates a cross-section of a portion of the display apparatus illustrated in FIG. 4.
Figure 5B:
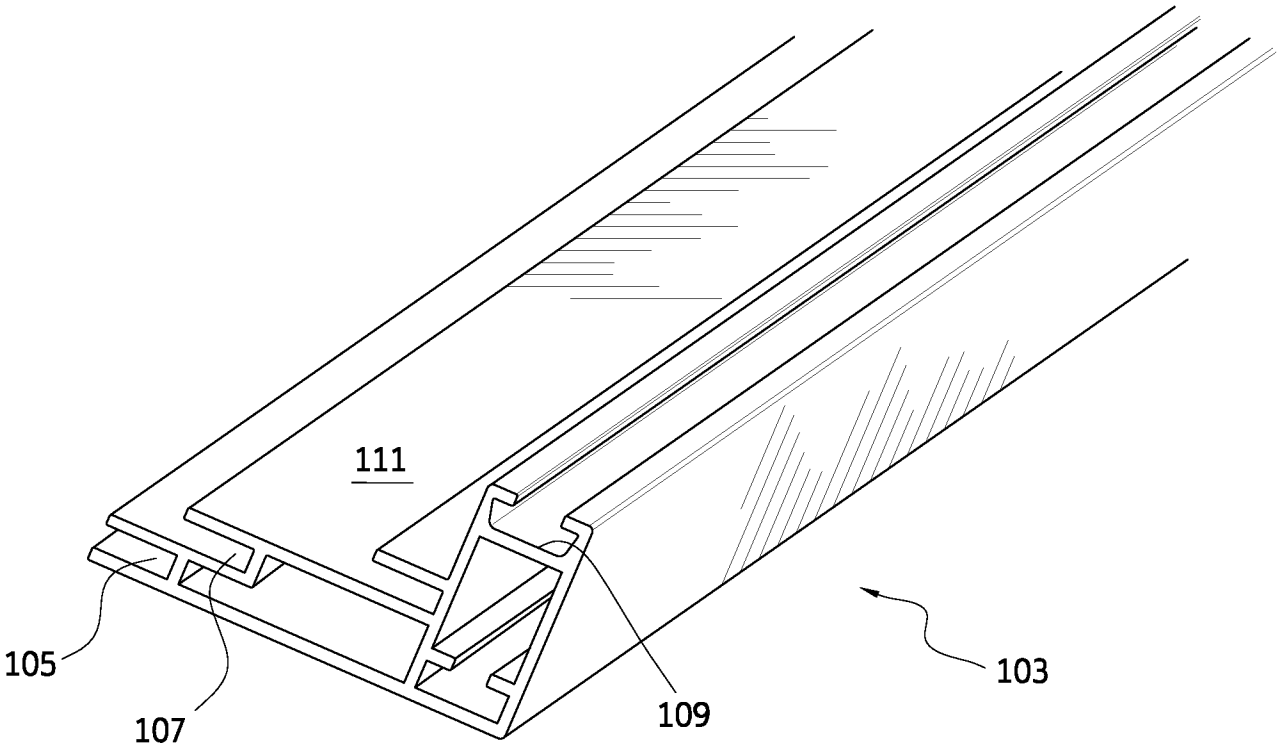
FIG. 5B illustrates a three-dimensional cross-section of a frame used in the embodiment of the invention illustrated in FIG. 4.
Figure 6:
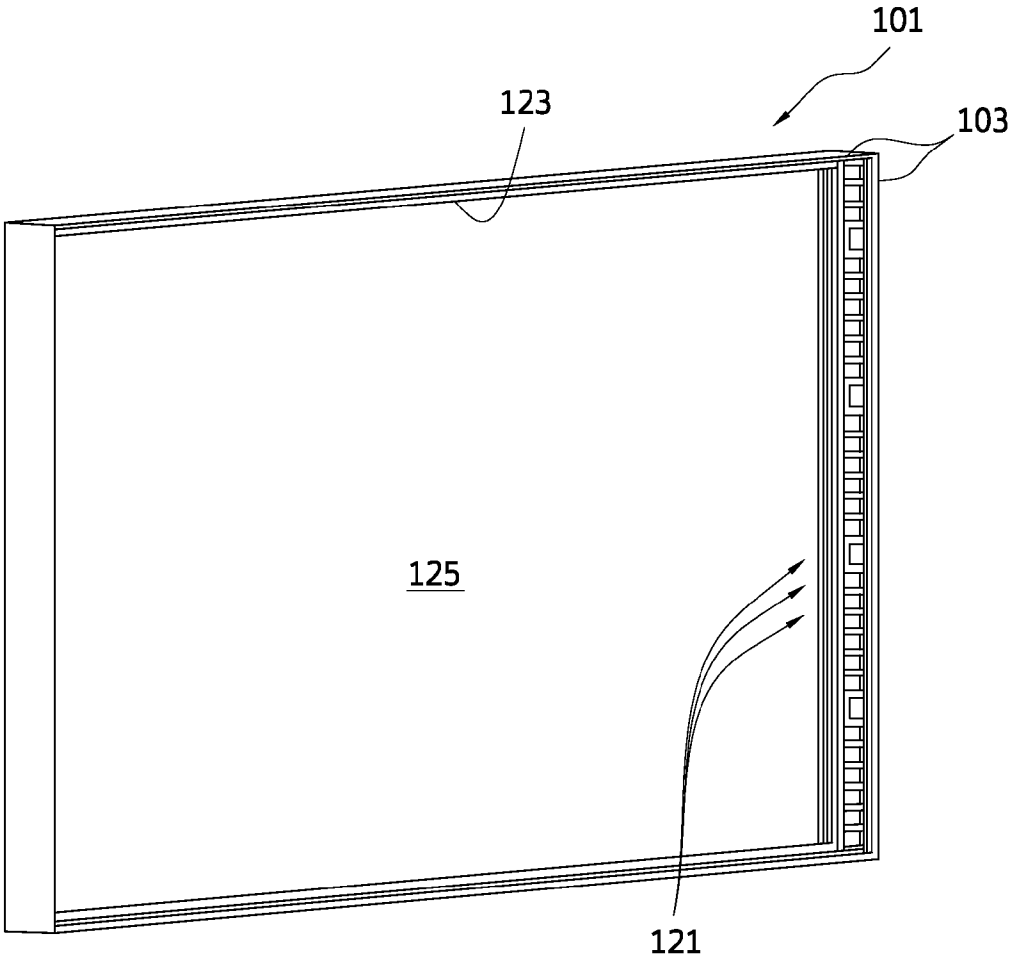
FIG. 6 illustrates an embodiment of a display apparatus, with certain fabric layers not depicted so that interior portions of the display apparatus may be seen.

As most easily seen in FIGS. 4, 5A, and 6, display 101 also includes a plurality of light sources mounted along one or more of the frame members of frame 103. In this particular example embodiment, a plurality of LED lights 121 are used and are mounted on the two vertical rail members (forming part of frame 103) such as depicted in FIG. 6. Additionally, in this embodiment, reflector strips 123 are installed on the horizontal rails facing inwardly towards the center of the display apparatus.

Assembled as such, when LED lights 121 are turned on or illuminated, the light from such LEDs essentially fully illuminates the backside of second layer 117. In preferred embodiments, however, the display apparatus is designed with specific parameters to ensure that a continuous light field of substantially uniform brightness is provided behind layer 117. This is accomplished, in this embodiment, by spacing LEDs approximately every 2.25-2.5 inches on the vertical rails and by using LEDs which produce a combination of both narrow and broad beams which, when shone together, combine to form a generally uniformly continuous light field. The production of the continuous light field, of substantially uniform brightness, is aided, at least in part, by the reflection of light (produced from LEDs 121) by reflector strips 123 and third layer 119. Moreover, in certain example embodiments, the broad and narrow beams can be angled to achieve a uniform field, such as at 45 degrees and 10 degrees, respectively.

Figure 8A:
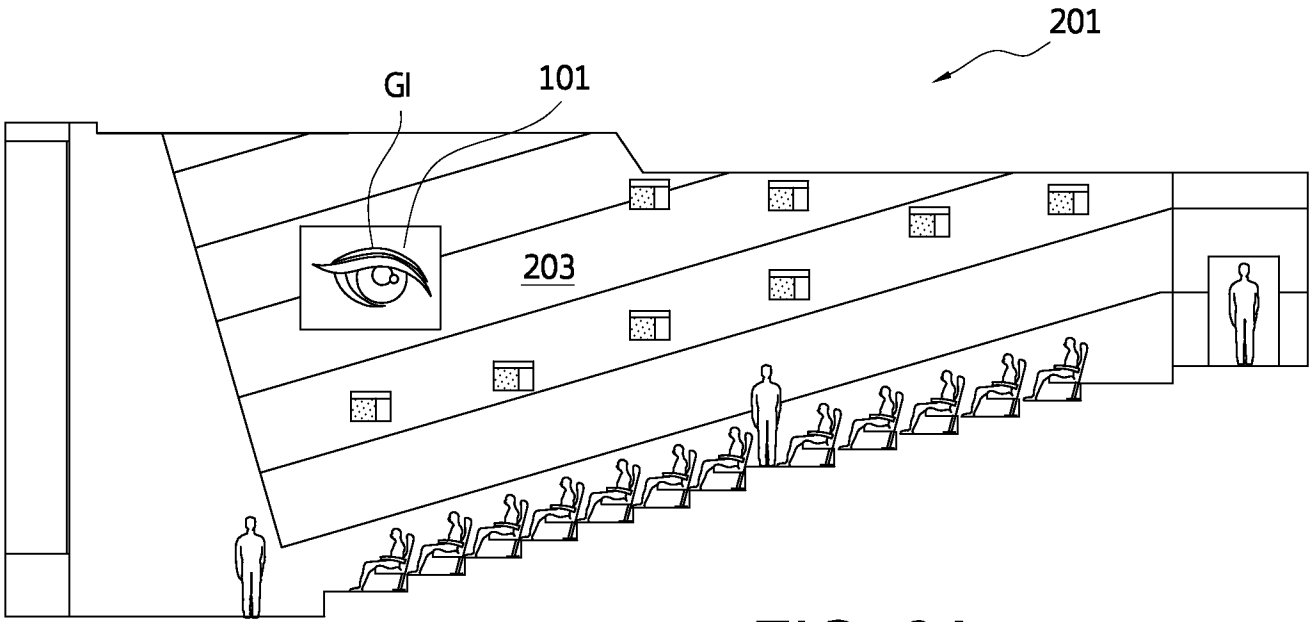
FIG. 8A illustrates one example environment in which the subject invention finds utility.
Figure 8B:
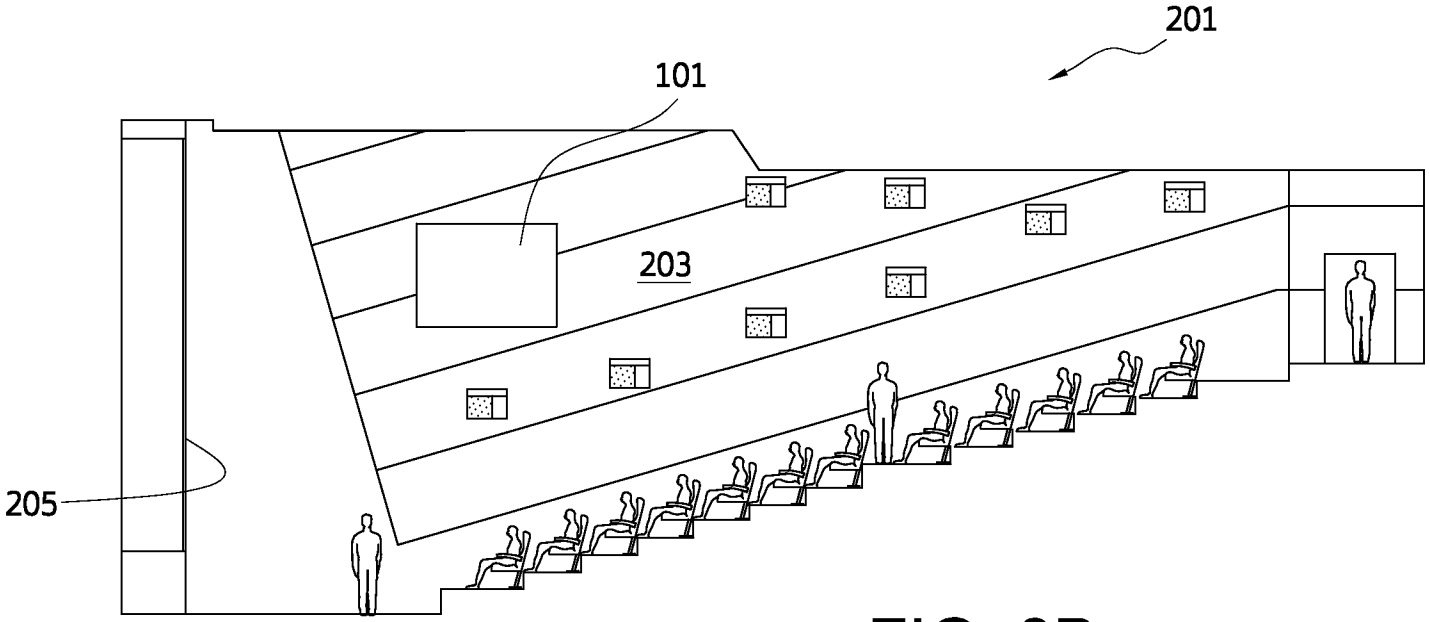
FIG. 8B illustrates an alternative example environment in which the subject invention finds utility.

In an example method of operating display apparatus 101, the display may be installed in a conventional movie theatre, such as the theatre depicted in FIGS. 8A and 8B. Installed, as such, the LED lighting system of the apparatus may be wired or synchronized with the main theatre lighting system. Moreover, the LEDs employed are preferably a type which include dimming capabilities. When employed in an environment such as shown, prior to the movie presentation beginning, LEDs 121 are illuminated or turned on. When illuminated, even though the graphical images "GI", printed on fabric layer 117, are physically concealed behind layer 115, layer 115 becomes visually transparent when backlit (see FIG. 8A). Therefore, the images GI, printed on layer 117, are visible to a viewer (e.g., theatre audience member). Conversely, however, as the movie presentation is going to begin, it is, of course, not desirable for display 101 to continue to display its image. For this reason, the apparatus has been designed so that when LEDs are turned off (and their illumination ceases), fabric layer 115 becomes essentially or completely opaque (see FIG. 8B) such that the image printed on layer 117 is no longer visible (preferably, layer 115 has a color which is similar or identical to the color of walls 203, so that the display becomes essentially invisible during the movie presentation).

Figure 9:
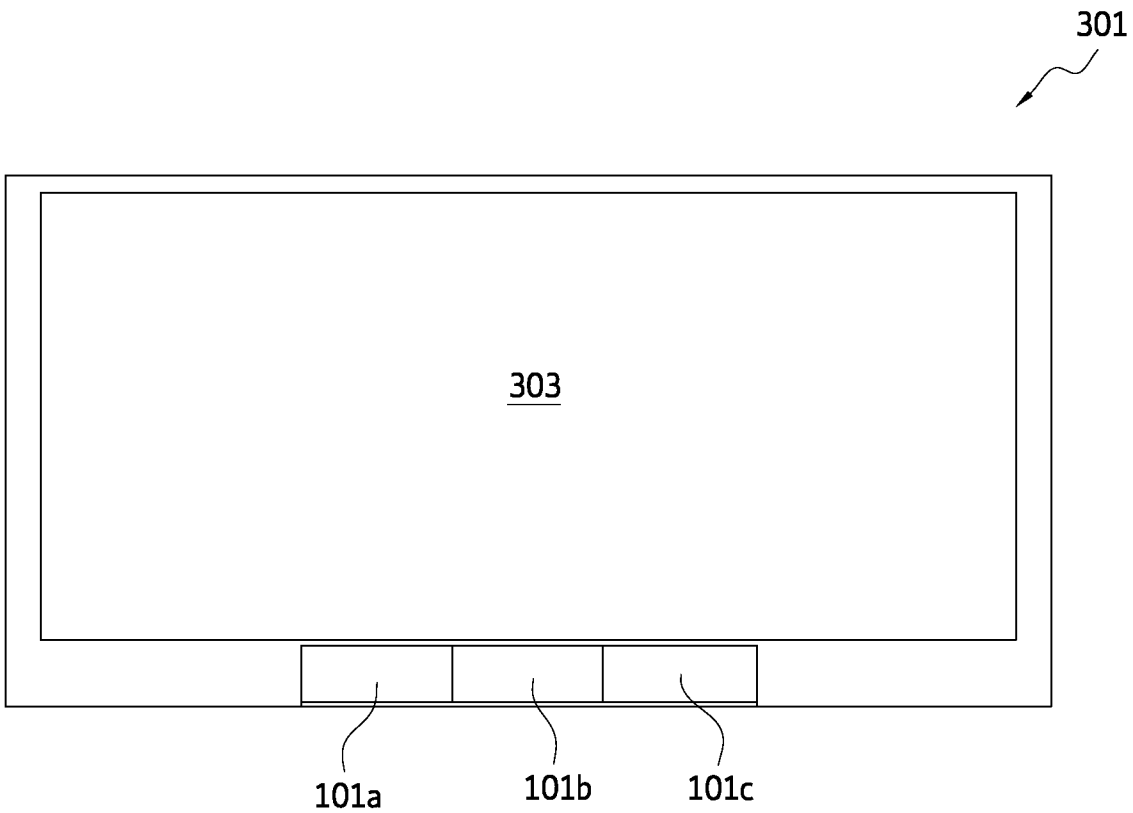
FIG. 9 illustrates an additional example environment in which an embodiment of the subject invention finds utility, where three of the herein described display apparatus are installed below a movie screen.

In an alternative movie theatre installation, such as depicted as 301 in FIG. 9, one or more displays 101 can be installed below a movie screen, for example. In the example depicted in FIG. 9, three displays 101*a*, 101*b*, and 101*c* are installed below movie screen 303. In this manner, three different images (or 3 identical images) can be displayed below the movie screen and may be shown simultaneously, or may be displayed alternatively (or in any other fashion) as desired. Of course, any size and shape display may be used as may be any number of displays, whether mounted above or below the movie screen or on theatre side walls.

Although many different embodiments are contemplated by the inventors, certain fabric types have been discovered to be particularly effective when employed in the various embodiments of the invention described herein. Other variations of fabric types and weights, etc. may of course, be employed. For example, first fabric layer 115 is preferably a sheer 100% polyester warp-knitted 3.8 oz/square yard mesh. This particular fabric selection allows double sided penetration of printing ink. Second Layer 117 is preferably a 100% polyester warp-knitted 8 oz/square yard fabric. And, third layer 119 is preferably a 100% polyester warp-knitted 8 oz/square yard, optically white layer (a "silvered" reflector layer could optionally be substituted, however).

Example LED types which can be employed are CREE XP-E WHT 6200K lights. When lenses are used, an oval lens which is particularly effective is a LEDIL Laura XP. Although display apparatus 101 may be powered by many types of acceptable power sources, a dimmable LED driver is an effective option.

Once given the above disclosure, many other features, modifications, and improvements will become apparent to the skilled artisan. Such features, modifications, and improvements are therefore considered to be part of this invention, without limitation imposed by the example embodiments described herein. Moreover, any word, term, phrase, feature, example, embodiment, or part or combination thereof, as used to describe or exemplify embodiments herein, unless unequivocally set forth as expressly uniquely defined or otherwise unequivocally set forth as limiting, is not intended to impart a narrowing scope to the invention in contravention of the ordinary meaning of the claim terms by which the scope of the patent property rights shall otherwise be determined:

We claim:

1. Apparatus comprising:

a frame having opposing rail portions;

a first fabric layer, carried by said frame, which is substantially acoustically transparent and which is at least partially visually transparent when backlit with light and which is substantially opaque when not backlit with light;

a second fabric layer, located behind and physically concealed by said first fabric layer and carried by said frame, said second fabric layer being at least partially light transmissive and including graphical images on at least a portion of a surface area thereof;

a third layer, spaced from and located behind said second fabric layer, comprised of a reflective surface facing said second fabric layer;

a plurality of light sources so physically located and oriented so as to, when turned on, provide a light field between said second fabric layer and said third layer, said reflective surface of said third layer interacting with said light field, when said plurality of light sources are turned on, to assist in homogenization of a brightness of said light field so as to result in a backlighting source comprised of a substantially continuous light field of substantially uniform brightness which, at least partially, transmits through said second fabric layer and said first fabric layer in a substantially uniform visually perceptible brightness; and wherein, when said plurality of light sources are turned on, said graphical images located on said second fabric layer are visually viewable when viewing an outward facing surface of said first fabric layer; and wherein when said plurality of light sources are turned off, said first fabric layer is substantially opaque and thereby conceals said graphical images from visual perception.

2. Apparatus according to claim 1 wherein said frame comprises a first set of two opposing rail members with a plurality of light sources mounted thereon, each of said two opposing rail members of said first set including light sources oriented generally facing each other, and a second set of two opposing rail members connected to said first set of two opposing rail members, said second set of two opposing rail members including reflective surfaces oriented generally facing each other.

3. Apparatus according to claim 2 wherein said first and said second sets of opposing rail members are connected to form a frame having a generally rectangular configuration.

4. Apparatus according to claim 3 wherein said first set of two opposing rail members, with said plurality of light sources mounted thereon, are shorter in length than said second set of two opposing rail members.

5. Apparatus according to claim 2 wherein said first fabric layer is mounted in a first plane spaced a distance x from said second fabric layer mounted in a second plane and wherein said third layer is mounted in a third plane spaced a distance y from said second layer on a side of said second layer opposite the location of said first layer.

6. Apparatus according to claim 5 wherein said first fabric layer is a sheer layer comprising warp knitted polyester mesh, having a weight selected from between approximately 2.8 and 4.8 oz per square yard, penetrated on both sides with printing ink.

7. Apparatus according to claim 6 wherein said second fabric layer comprises warp knitted polyester mesh, having a weight selected from between approximately 6 and 10 oz per square yard, with graphical images printed thereon.

8. Apparatus according to claim 7 wherein said third layer is a fabric layer comprising warp knitted polyester mesh, having a weight selected from between approximately 6 and 10 oz per square yard, which is optically white on at least one side.

9. Apparatus according to claim 5 wherein said plurality of light sources are LED lights.

10. Apparatus according to claim 9 wherein said plurality of light sources are LED lights mounted spaced between 1.5 to 4.0 inches apart projecting a combination of broad and narrow light beams at one or more angles such that, said combination of broad and narrow light beams, in aggregate, form said backlighting source comprised of a substantially continuous light field of substantially uniform brightness.

11. Apparatus according to claim 9 wherein said plurality of light sources are LED lights mounted spaced between 1.5 to 4.0 inches apart projecting a combination of broad and narrow light beams at one or more angles such that, said combination of broad and narrow light beams, in aggregate, form said backlighting source comprised of a substantially continuous light field of substantially uniform brightness, and wherein said narrow beams are projected at angles selected from between approximately 5 and 15 degrees and said broad beams are projected at angles selected from between approximately 40 and 50 degrees.

12. Apparatus according to claim 9 wherein said plurality of light sources are LED lights mounted spaced between 1.5 to 4.0 inches apart, said LED lights projecting a combination of broad and narrow light beams at one or more angles such that, said combination of broad and narrow light beams, in aggregate, form said backlighting source comprised of a substantially continuous light field of substantially uniform brightness, and wherein said narrow beams are projected in a selected manner to reflect off of said third layer and said reflective surfaces of said opposing rail members, in combination, and said broad beams are projected in a selected manner to diffuse light across broad portions of said second fabric layer.

13. Apparatus according to claim 10 wherein said plurality of light sources are LED lights which are dimmable.

14. Apparatus according to claim 13 wherein said second fabric layer contains graphical images printed with dye sublimation techniques.

15. Apparatus according to claim 13 wherein said plurality of light sources are LED lights equipped with substantially oval lenses.

16. Apparatus according to claim 15 wherein said distance x is selected from between approximately ¼ and ¾ of one inch.

17. Apparatus according to claim 16 wherein said distance y is selected from between approximately 2 and 12 inches.

* * * * *